US009605685B2

(12) United States Patent
Wang

(10) Patent No.: US 9,605,685 B2
(45) Date of Patent: Mar. 28, 2017

(54) CEILING FAN

(71) Applicant: YOUNGO LIMITED, Hong Kong (CN)

(72) Inventor: Cliff Wang, Taichung (TW)

(73) Assignee: YOUNGO LIMITED, Hong Kong (CN)

( * ) Notice: Subject to any disclaimer, the term of this patent is extended or adjusted under 35 U.S.C. 154(b) by 316 days.

(21) Appl. No.: 14/535,232

(22) Filed: Nov. 6, 2014

(65) Prior Publication Data

US 2016/0131152 A1 May 12, 2016

(51) Int. Cl.

| | |
|---|---|
| ***F04D 29/34*** | (2006.01) |
| ***F04D 25/08*** | (2006.01) |
| ***F04D 19/00*** | (2006.01) |

(52) U.S. Cl.

CPC ..... *F04D 29/34* (2013.01); *F04D 19/002* (2013.01); *F04D 25/088* (2013.01)

(58) Field of Classification Search

CPC ..... F04D 29/34; F04D 19/002; F04D 25/088; F04D 29/325; F04D 29/329; F04D 29/38; F04D 29/388; F04D 29/66; F05D 2260/30; F05D 2260/96

See application file for complete search history.

(56) References Cited

U.S. PATENT DOCUMENTS

| | | | | |
|---|---|---|---|---|
| 7,163,377 | B2 * | 1/2007 | Blateri | F04D 29/34 416/210 R |
| 7,481,626 | B2 * | 1/2009 | Gajewski | F04D 25/088 416/204 R |
| 2014/0119925 | A1 * | 5/2014 | Wang | F04D 29/34 416/204 R |

* cited by examiner

*Primary Examiner* — John K Fristoe, Jr.
*Assistant Examiner* — John Hunter
(74) *Attorney, Agent, or Firm* — Ming Chow Sinorica, LLC

(57) ABSTRACT

A ceiling fan includes a motor and plural blades. The motor has its topside and underside respectively secured with a fixed seat, which has its inner side formed with two protruding edges spaced apart and respectively having a pressing plate fixed thereon. The pressing plates are correspondingly combined with the fixed seats so that the blades can be firmly combined with the fixed seats via the pressing plates. The pressing plates can easily be processed and made by small-sized forming molds, able to lower manufacturing cost, and the blades of this invention can be secured on the motor quickly and stably and driven to rotate smoothly and steadily. Further, during assembly of the blades, fine adjustment can be done to respective assembly structure for overcoming errors caused by tolerance. To sum up, this invention is able to shorten man-hour in assembly, enhance assembly efficiency and increase economic gains.

7 Claims, 8 Drawing Sheets

CEILING FAN

BACKGROUND OF THE INVENTION

1. Field of the Invention

This invention relates to a ceiling fan.

2. Description of the Prior Art

A commonly seen ceiling fan generally includes a motor and a plurality of blades. The blades are firmly combined with the motor by means of fixing members provided on the outer casing of the motor.

As illustrated in FIGS. 1-2, a conventional ceiling fan, as disclosed in a U.S. Pat. No. 7,481,626, includes a motor 1 and a plurality of blades 2. The motor 1 has its outer circumferential side formed with a plurality of threaded cylinders 3, while each blade 2 has its inner side formed with plural protruding edges 4 respectively bored with plural insert holes 5 that correspond to the threaded cylinders 3, and the location and size of the insert holes 5 can be exactly combined and fixed with the threaded cylinders 3. Further, a plurality of locking fasteners 6 are provided to be respectively inserted through the insert holes 5 and threadably locked with the threaded cylinders 3 for securing the blades 2 on the motor 1.

However, after long-term use of the conventional ceiling fan and in the process of researching and developing ceiling fans, the inventor of this invention found that the blade assembly structure of the conventional ceiling fan can hardly lock and fix the blades 2 stably on the motor 1 and as a result, when the conventional ceiling fan is operated to rotate, the blades 2 are apt to sway, and the combination parts of the blades 2 and the motor 1 will produce vibration and give out abnormal sounds. Further, slight tolerance between the threaded cylinders 3 and the insert holes 5 makes it hard to have the insert holes 5 simultaneously aligned to the threaded cylinders 3 in a process of assembly of the ceiling fan, thus difficult in combining the blades 2 on the motor 1, taking a lot of work and time in assembly of the ceiling fan and hence lowering economic gains. Furthermore, the protruding threaded cylinders 3 at the outer circumferential side of the motor 1 must be made up by large-sized forming molds, rendering difficult in processing, high in manufacturing cost and thus unable to enhance market competitiveness.

In view of such drawbacks of the conventional ceiling fan, the inventor of this invention, who has been devoted to development and manufacturing of various types of ceiling fans and related components for many years and has much experience in marketing, constantly strives for perfection and thinks that the conventional ceiling fan has to be ameliorated and hence devises this invention.

SUMMARY OF THE INVENTION

The objective of this invention is to offer a ceiling fan whose blades can be secured on a motor easily and stably and rotated smoothly and steadily. Further, during assembly of the blades, fine adjustment can be done to respective assembly structure for overcoming errors caused by tolerance. This invention is able to shorten man-hour in assembly, heighten assembly efficiency, increase economic benefits, lower manufacturing cost and enhance market competitiveness.

The ceiling fan in the present invention includes a motor provided with a shaft rod that is axially positioned in the center of the motor, with the motor rotated relative to the shaft rod. At least one fixed seat is horizontally secured with the motor and has its circumferential edge protruding out of the motor and bored with a plurality of insert holes, which are exposed to the outer side of the motor. A plurality of blades are respectively formed with a longitudinal extension portion corresponding with the outer circumferential side of the motor. The extension portion of the blade has its inner side transversely disposed with at least one protruding edge, which is provided with plural leading holes corresponding to the insert holes of the fixed seat. A plurality of pressing plates are respectively fixed on the protruding edges, respectively formed with plural threaded cylinders that correspond with the leading holes of the protruding edge. A plurality of locking fasteners are to be threadably locked with the threaded cylinders after these threaded cylinders of the pressing plates are inserted through both the leading holes of the protruding edge and the insert holes of fixed seats to have the threaded cylinders fixed at the locations of the insert holes of the fixed seats for fixing the blades on the fixed seats.

By so designing, the blades of the ceiling fan of this invention can easily and stably be assembled on the fixed seats via the pressing plates that are secured with the blades. Moreover, in the process of assembling and locking members, the mutual relative positions of the members can be fine adjusted so as to overcome errors caused by tolerance to enable the blades to be fixed on the motor quickly and stably and rotated smoothly and steadily. As can be understood from the above description, this invention is able to save man-hour in assembly, heighten assembly effect and increase economic gains. Further, the pressing plates of this invention are small in area so the pressing plates can be processed and made up by small-sized forming molds, thus able to lower manufacturing cost and enhance market competitiveness.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
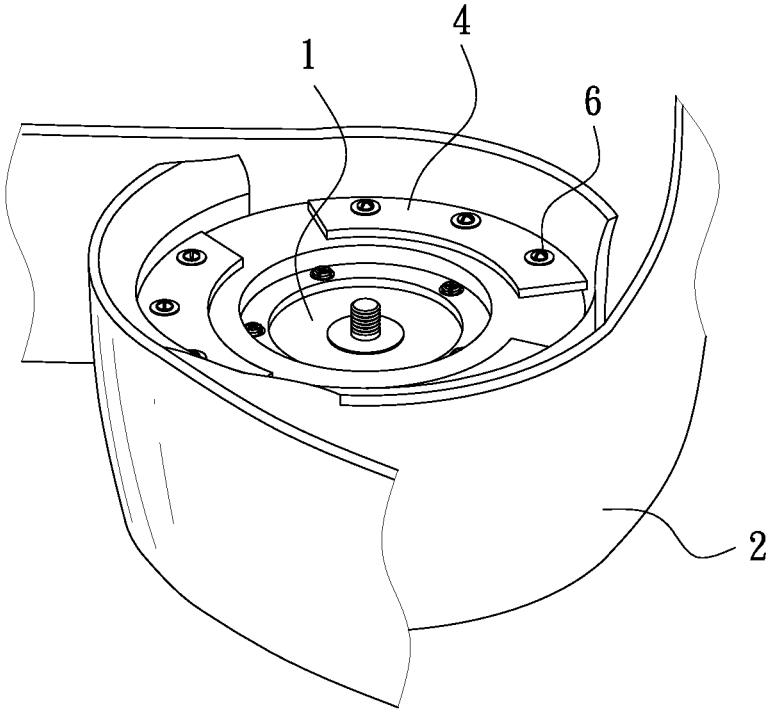
FIG. 1 PRIOR ART
FIG. 1 is a schematic view of the assembly structure of a conventional ceiling fan.
Figure 2:
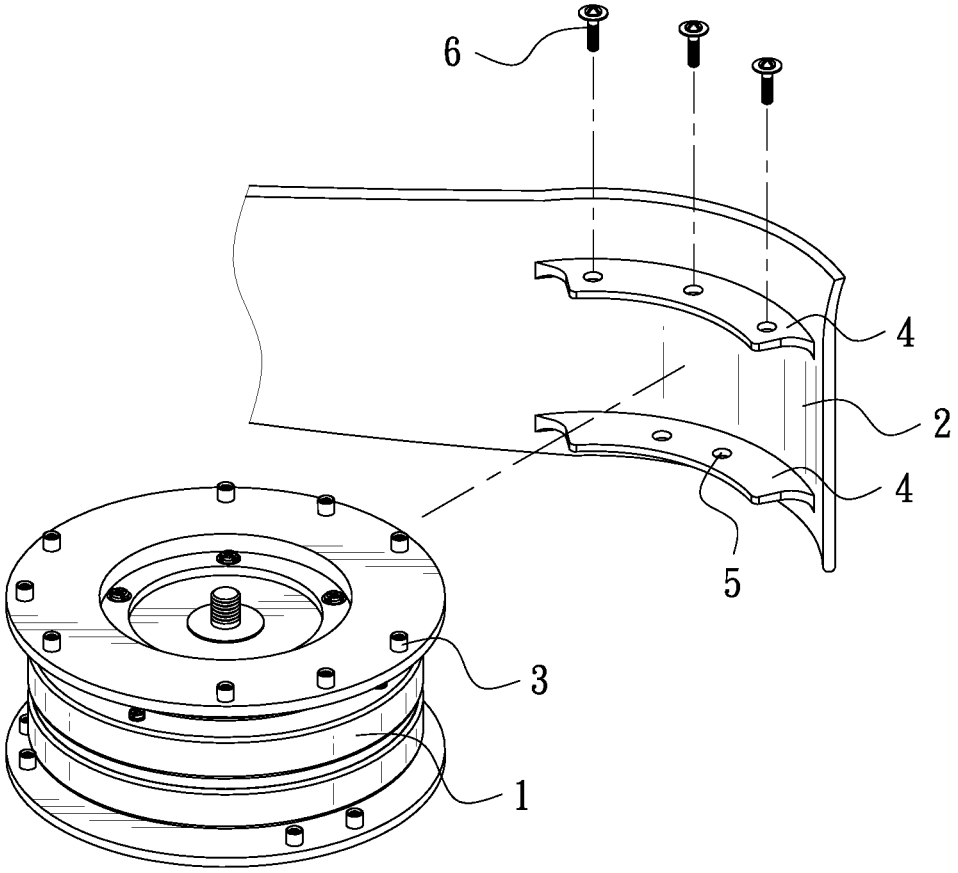
FIG. 2 PRIOR ART
FIG. 2 is an exploded perspective view of the conventional ceiling fan.
Figure 3:
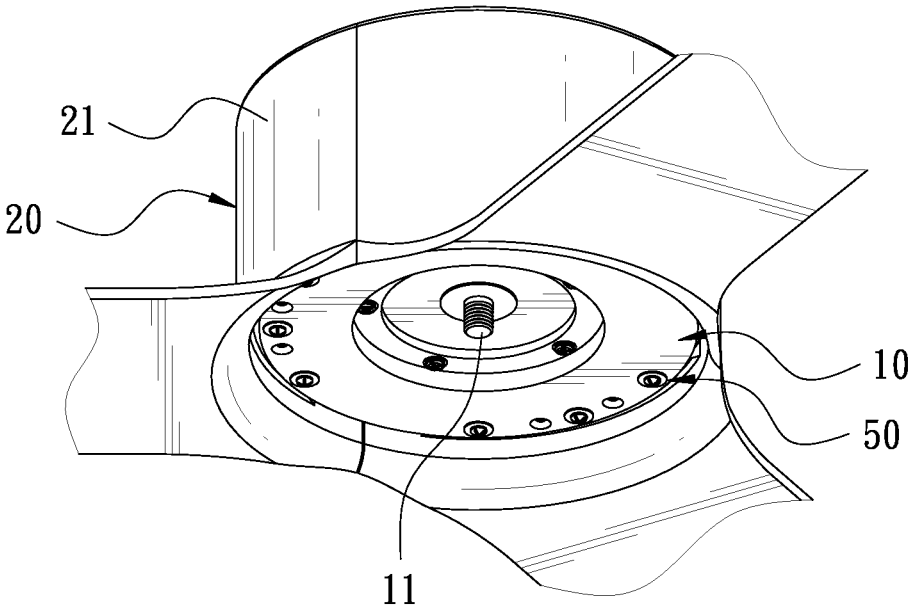
FIG. 3 is a perspective view of a ceiling fan in the present invention.
Figure 4:
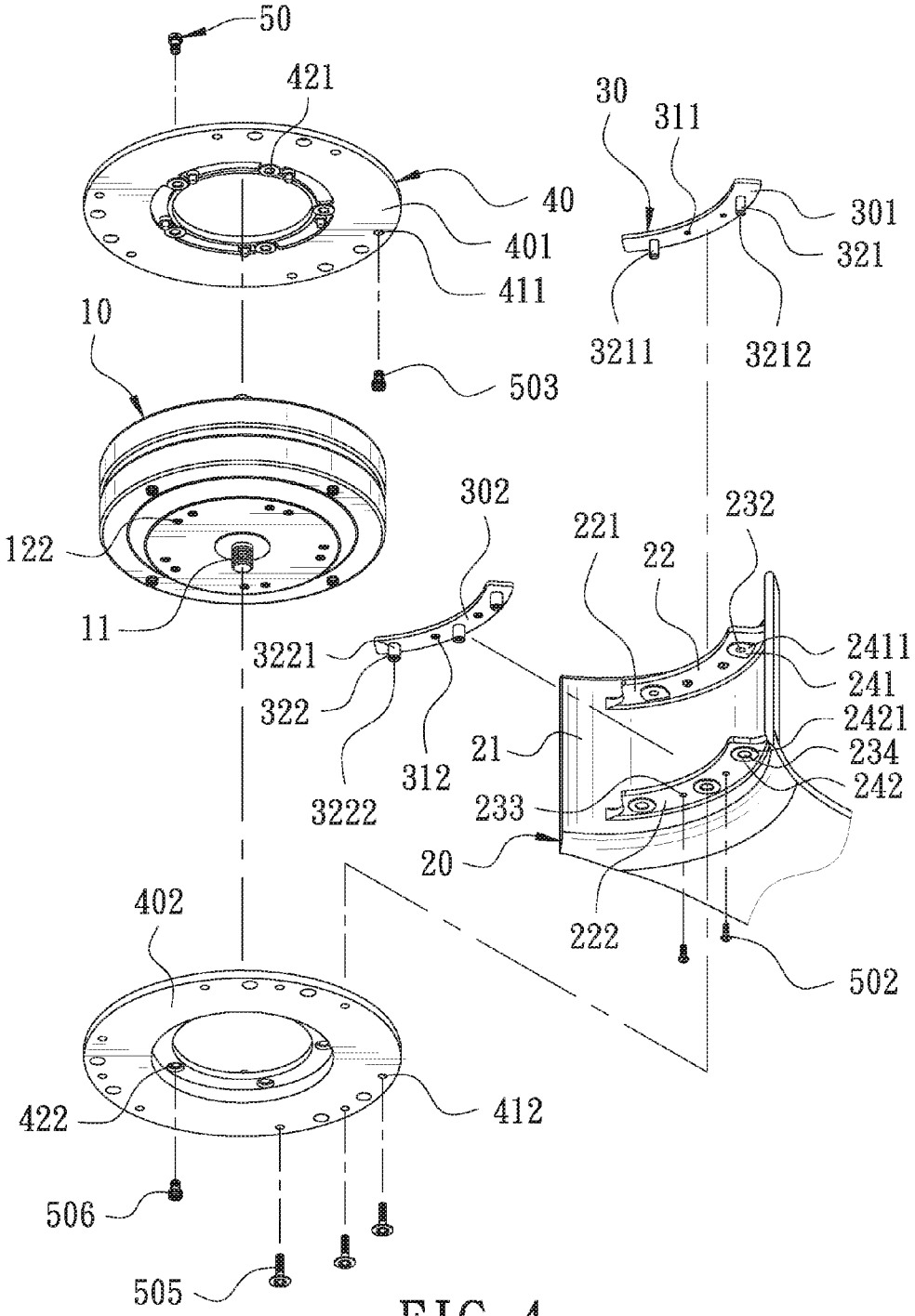
FIG. 4 is an exploded perspective view of the ceiling fan in the present invention.
Figure 5:
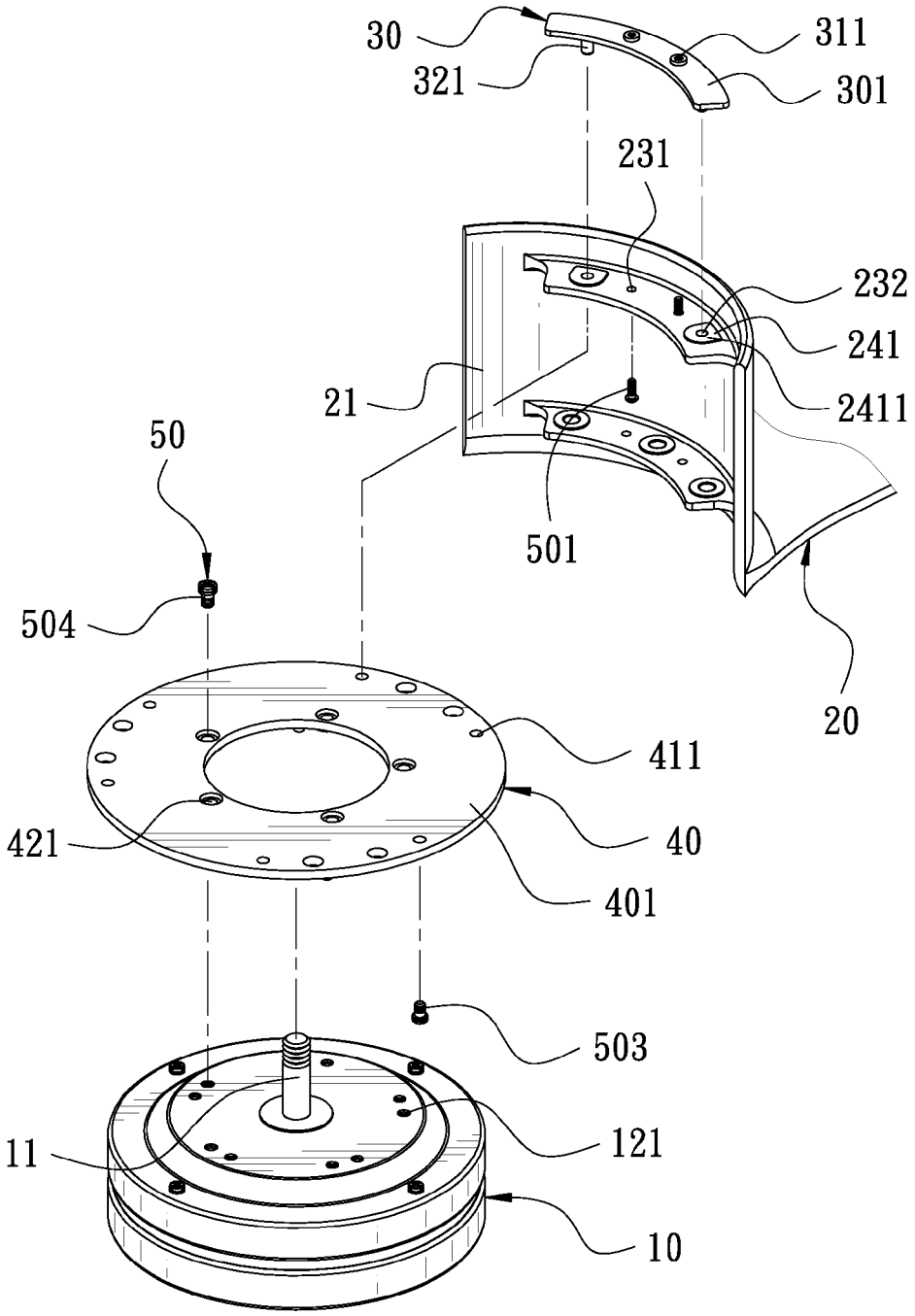
FIG. 5 is a schematic view illustrating that a blade is to be assembled with a first fixed seat of the ceiling fan in the present invention.
Figure 6:
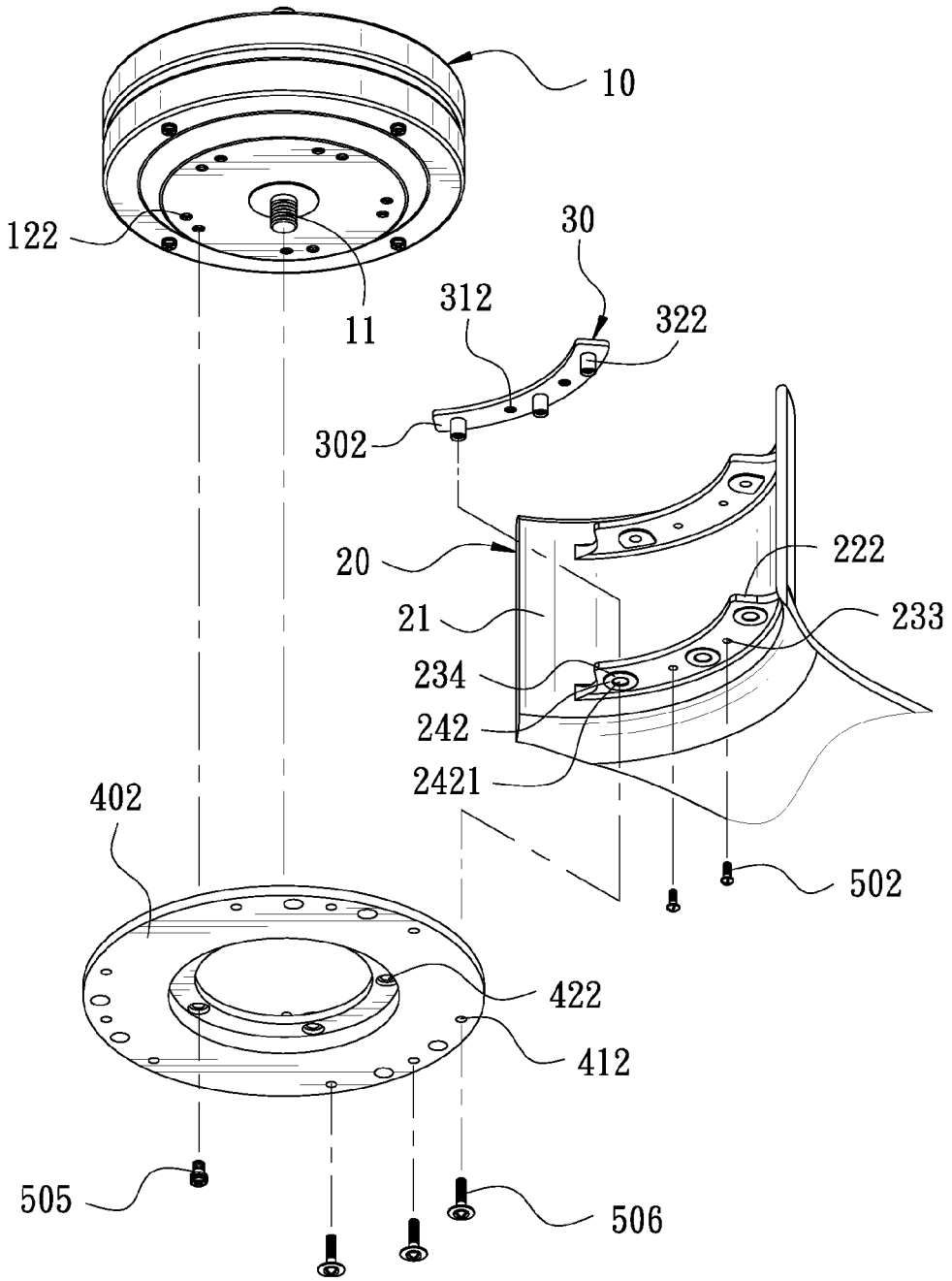
FIG. 6 is a schematic view illustrating that a blade is to be assembled with a second fixed seat of the ceiling fan in the present invention.

A preferred embodiment of a ceiling fan in the present invention, as shown in FIGS. 3-8, includes a motor 10, at least one fixed seat 40, a plurality of blades 20, a plurality of pressing plates 30 and a plurality of locking fasteners 50 as main components combined together.

The motor 10 is formed with a shaft rod 11 axially positioned in the center of the motor 10, and the motor 10 can be rotated relative to the shaft rod 11. The motor 10 is provided with a plurality of first threaded holes 121 and second threaded holes 122, and the first threaded holes 121 corresponding to the shaft rod 11 are spaced apart and annularly positioned at the topside of the motor 10, while the second threaded holes 122 corresponding to the shaft rod 11 are spaced apart and annularly formed at the underside of the motor 10.

The fixed seat 40 is correspondingly combined with the motor 10. In this invention, there are two fixed seats 40 respectively and correspondingly disposed at the topside and the underside of the motor 10. The fixed seat 40 positioned at the topside of the motor 10 is defined to be a first fixed seat 401, while the fixed seat 40 provided at the underside of the motor 10 defined to be a second fixed seat 402. The first fixed seat 401 is bored with plural first insert holes 411 and further bored with plural second insert holes 421 that correspond with the first threaded holes 121 of the motor 10, and the second fixed seat 402 is bored with plural third insert holes 412 and further bored with plural fourth insert holes 422 corresponding to the second threaded holes 122 of the motor 10.

The blades 20 are respectively formed with an extension portion 21, which is approximately arc-shaped for corresponding with the outer circumferential side of the motor 10. The extension portion 21 of the blade 20 has its inner side formed with at least one protruding edge 22 corresponding to the motor 10. In this invention, the extension portion 21 has its inner side formed with two protruding edges 22, which are respectively defined to be a first protruding edge 221 and a second protruding edge 222. The first protruding edge 221 corresponding to the topside of the motor 10 is provided with plural first leading holes 231 and plural second leading holes 232. The second leading holes 232 correspond to the first insert holes 411 of the first fixed seat 401 and each second leading hole 232 is mounted therein with a first shock-proof ring 241, which has its two axial ends respectively and radially extending outward to form a bulging portion 2411, and the distance between the two bulging portions 2411 exactly corresponds to the thickness of the first protruding edge 221 so that the first shock-proof ring 241 can be fitted and restrictedly positioned in the second leading hole 232. The second protruding edge 222 corresponding to the underside of the motor 10 is provided with plural third leading holes 233 and plural fourth leading holes 234. The fourth leading holes 234 corresponding to the third insert holes 412 of the second fixed seat 402 is disposed with a second shock-proof ring 242, which has its two axial ends respectively and radially stretching outward to form a bulging portion 2421, and the distance between the two bulging portions 2421 exactly corresponds to the thickness of the second protruding edge 222 so that the second shock-proof ring 242 can be fitted and restrictedly positioned in the fourth leading hole 234.

The pressing plates 30 are approximately shaped as one-third of a circular arc, respectively defined to be plural first pressing plates 301 and plural second pressing plates 302. The first pressing plate 301 corresponds to the first protruding edge 221, bored with plural first locking holes 311 corresponding with the first leading holes 231 of the first protruding edge 221 and provided with plural first threaded cylinders 321 that correspond to the second leading holes 232 of the first protruding edge 221. The first threaded cylinders 321 can be inserted through the first shock-proof rings 241 and in this invention, the first threaded cylinder 321 is a first protruding stud 3211 that is axially formed with a first internal threaded hole 3212. The second pressing plate 302 corresponds to the second protruding edge 222, bored with plural second locking holes 312 corresponding with the third leading holes 233 of the second protruding edge 222 and further provided with plural second threaded cylinders 322 that correspond to the fourth leading holes 234 of the second protruding edge 222. The second threaded cylinder 322 can be inserted through the second shock-proof ring 242 and in this invention, the second threaded cylinder 322 is a second protruding stud 3221 that is axially bored with a second internal threaded hole 3222.

The locking fasteners 50 are defined to be plural first locking fasteners 501, plural second locking fasteners 502, plural third locking fasteners 503, plural fourth locking fasteners 504, plural fifth locking fasteners 505 and plural sixth locking fasteners 506. The first locking fasteners 501 are inserted through the first leading holes 231 and threadably locked in the locking holes 311 of the first pressing plate 301 to have the first pressing plate 301 firmly secured on the topside of the first protruding edge 221. The second locking fasteners 502 are inserted through the third leading holes 233 and threadably locked in the second locking holes 312 for locking and fixing the second pressing plate 302 on the topside of the second protruding edge 222. The third locking fasteners 503 are to be screwed with the first threaded cylinders 321 of the first pressing plate 301 to lock and fix the first threaded cylinders 321 at the locations of the first insert holes 411 of the first fixed seat 401 after the first threaded cylinders 321 are inserted through the second leading holes 232 of the first protruding edge 222 and through the first insert holes 411 of the first fixed seat 401. The fourth locking fasteners 504 are inserted through the second insert holes 421 of the first fixed seat 401 and threadably locked with the first threaded holes 121 of the motor 10 for firmly locking the first fixed seat 401 on the topside of the motor 10. The fifth locking fasteners 505 are to be screwed with the second threaded cylinders 322 of the second pressing plate 302 to have the second threaded cylinders 322 secured at the locations of the third insert holes 412 of the second fixed seat 402 after the second threaded cylinders 322 are inserted through the fourth leading holes 234 of the second protruding edge 222 and through the third insert holes 412 of the second fixed seat 402. The sixth locking fasteners 506 are inserted through the fourth insert holes 422 of the second fixed seat 402 and threadably locked with the second threaded holes 122 of the motor 10 for securing the second fixed seat 402 at the underside of the motor 10.

In assembly of the ceiling fan of this invention, referring to FIGS. 5 to 8, firstly, the first pressing plate 301 is correspondingly set on the topside of the first protruding edge 221 to have the first threaded cylinders 321 respectively inserted through the shock-proof rings 241 and at this time, the first locking holes 311 of the first pressing plate 301 are aligned to the first leading holes 231 of the first protruding edge 221. Then, the first locking fasteners 501 are respectively inserted through the first leading holes 231 of the first protruding edge 221 and threadably locked with the first locking holes 311 of the first pressing plate 301 so that the first pressing plate 301 can be firmly fixed on the topside of the first protruding edge 221. Subsequently, the second pressing plate 302 is correspondingly deposited on the topside of the second protruding edge 222 to have the second threaded cylinders 322 respectively inserted through the second shock-proof rings 242 to let the second locking holes 312 respectively aligned to the third leading holes 233. At this time, the second locking fasteners 502 can be inserted through the third leading holes 233 of the second protruding edge 222 and threadably locked with the second locking holes 312 of the second pressing plate 302 to fixedly lock the second pressing plate 302 on the topside of the second protruding edge 222.

Figure 7:
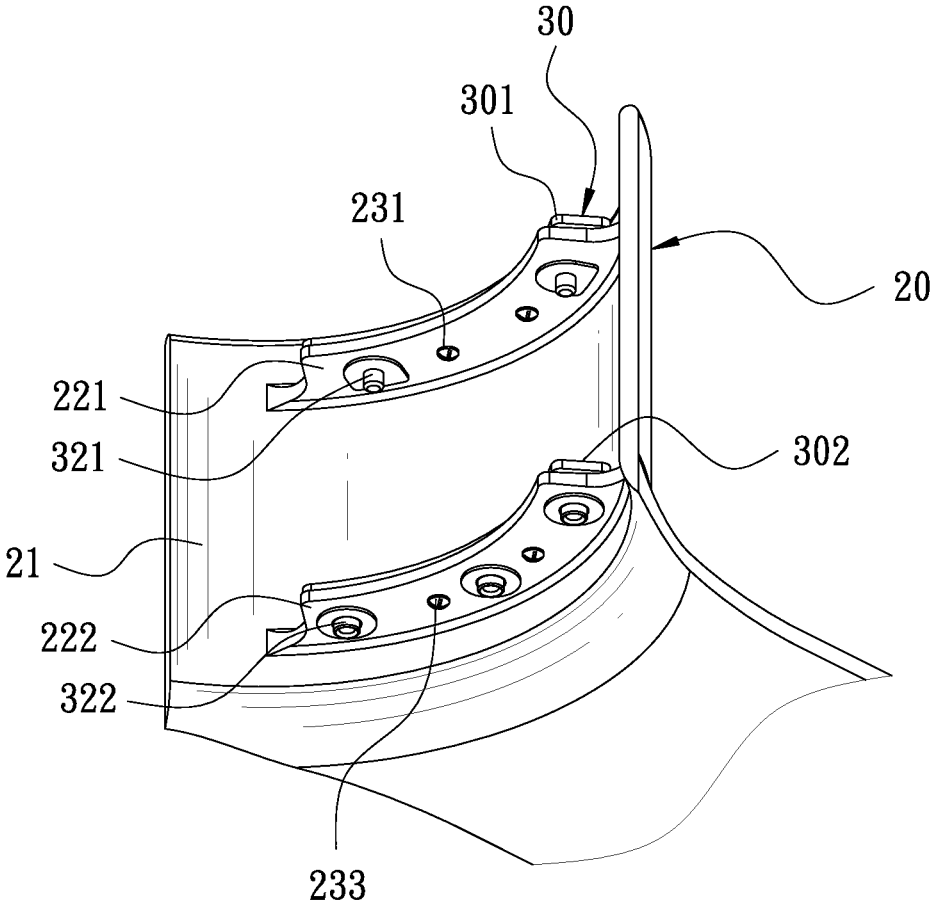
FIG. 7 is a schematic view illustrating that a blade is assembled with a pressing plate in the present invention.
Figure 8:
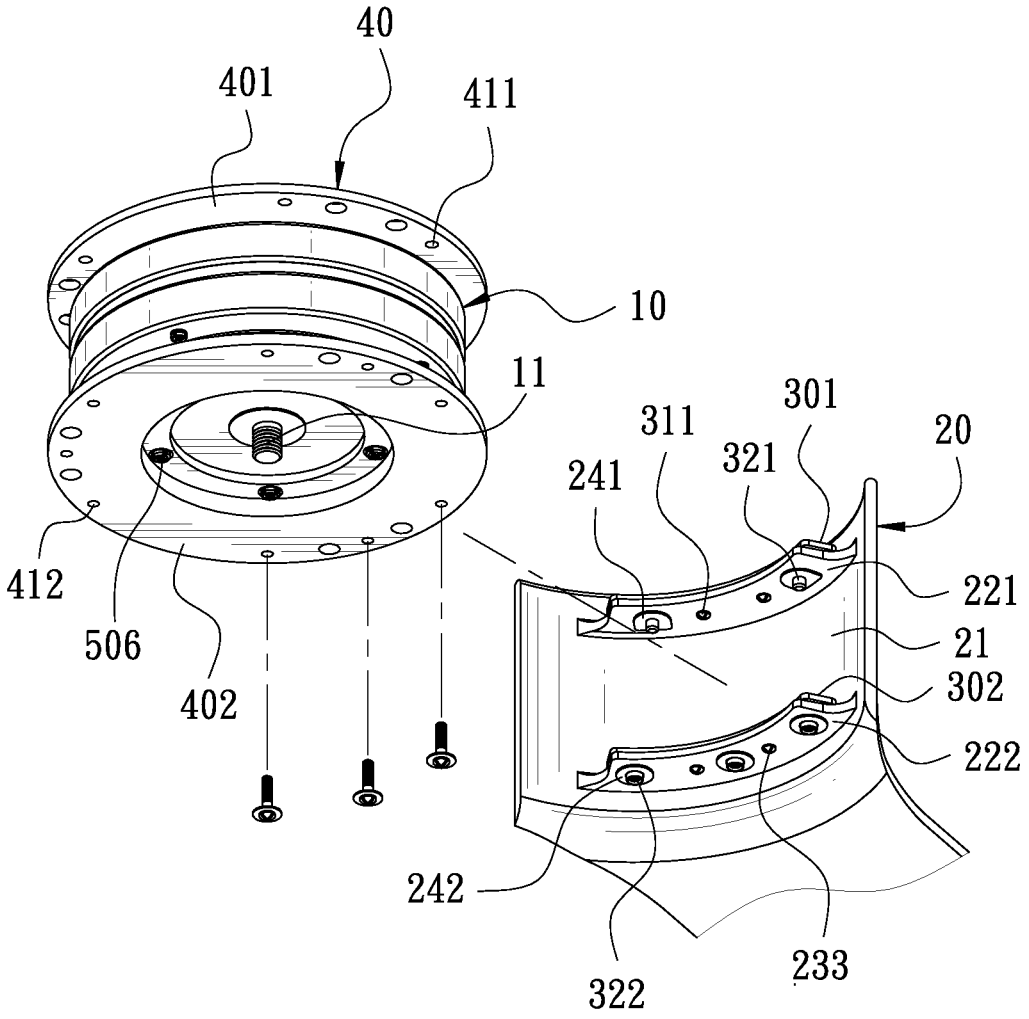
FIG. 8 is a schematic view of assembly of the ceiling fan in the present invention.

Referring to FIGS. 7 and 8, after the first pressing plate 301 and the second pressing plate 302 are respectively fixed on the topside of the first protruding edge 221 and on the topside of the second protruding edge 222, the first fixed seat 401 is positioned on the topside of the motor 10, letting the second insert holes 421 respectively aligned to the first threaded holes 121 of the motor 10. Then, the fourth locking fasteners 504 are respectively inserted through the second insert holes 421 of the first fixed seat 401 and screwed with the first threaded holes 121 of the motor 10 to have the first fixed seat 401 firmly locked on the topside of the motor 10. Afterward, the second fixed seat 402 is set at the underside of the motor 10, letting the fourth insert holes 422 of the second fixed seat 402 respectively aligned to the second threaded holes 122 of the motor 10 for securing the second fixed seat 402 at the underside of the motor 10. Then, the first threaded cylinders 321, which were inserted through the second leading holes 232, are further inserted through the first insert holes 411 of the first fixed seat 401 and then locked and fixed at the locations of the first insert holes 411 by the third locking fasteners 503. Meanwhile, the second threaded cylinders 322, which were inserted through the fourth leading holes 234, are further inserted through the third insert holes 412 of the second fixed seat 402 and then locked and secured at the locations of the third insert holes 412 by the fifth locking fasteners 505.

Thus, the blades 20 can be stably secured on the motor 10 with easiness. Since respective assembly structure mentioned above can be fine adjusted in mutual relative positions when carrying out assembling and locking of members; therefore, errors caused by tolerance can easily be overcome, and the blades 20 can be fixed on the motor 10 stably and driven to rotate smoothly and steadily. By so designing, the blades 20 of the ceiling fan of this invention can quickly and firmly be locked on the motor 10, able to shorten man-hour in assembly, elevate assembly efficiency and increase economic gains. In addition, the shock-proof rings provided on the protruding edges can function to prevent the blades from causing vibration or swaying when the blades are rotated so that the ceiling fan can be operated smoothly and noiselessly.

One of the special features of this invention is that the pressing plate 30 is quite small in area so the pressing plate 30 can easily be processed and made up by small-sized forming molds. Compared with the conventional processing and manufacturing modes that the protruding threaded cylinders at the outer circumferential side of the motor have to be formed by large-sized shaping molds, this invention is lower in manufacturing cost and hence able to enhance market competitiveness.

As can be understood from the above description, this invention has the following advantages:

1. The blades of the ceiling fan of this invention can be secured on the motor quickly and stably and driven to rotate smoothly and steadily, able to avoid producing vibration or swaying.

2. During assembly of the blades, fine adjustment can be done to respective assembly structure so as to overcome errors caused by tolerance.

3. This invention is able to shorten man-hour in assembly, elevate assembly efficiency, increase economic gains, lower manufacturing cost and heighten market competitiveness.

While the preferred embodiment of the invention has been described above, it will be recognized and understood that various modifications may be made therein and the appended claims are intended to cover all such modifications that may fall within the spirit and scope of the invention.

What is claimed is:

1. A ceiling fan comprising:

a motor formed with a shaft rod, said shaft rod axially fixed in the center of said motor, said motor rotated relative to said shaft rod;

at least one fixed seat combined with said motor, said at least one fixed seat provided horizontally, said at least one fixed seat having a circumferential edge protruding out of said motor, said at least one fixed seat provided with a plurality of insert holes at locations of circumferential edge, said insert holes exposed to an outer side of said motor;

a plurality of blades, each said blade formed with a longitudinal extension portion, said extension portion corresponding to an outer circumferential side of said motor, said extension portion having an inner side transversely formed with at least one protruding edge, said protruding edge bored with plural leading holes that correspond to said insert holes of said at least one fixed seat;

a plurality of pressing plates respectively secured on said protruding edge, each said pressing plate provided thereon with plural threaded cylinders that correspond with said leading holes of said protruding edge, said threaded cylinders able to be inserted through said leading holes; and a plurality of locking fasteners to be respectively screwed with said threaded cylinders of said pressing plates;

Thus, after said threaded cylinders of said pressing plates are inserted through said leading holes of said blades and through said insert holes of said at least one fixed seat, said locking fasteners able to be respectively screwed with said threaded cylinders of said pressing plates for fixing said threaded cylinders at locations of said insert holes of said at least one fixed seat to have said blades secured with said at least one fixed seat.

2. The ceiling fan as claimed in claim 1, wherein said leading hole of said protruding edge of said blade is mounted therein with a shock-proof ring.

3. The ceiling fan as claimed in claim 2, wherein said shock-proof ring has two axial ends respectively and radially extending outward to form a bulging portion, a distance between said two bulging portions with a thickness of said protruding edge, said shock-proof ring able to be fitted and restrictedly positioned in said leading hole.

4. The ceiling fan as claimed in claim 1, wherein said extension portion of said blade is approximately arc-shaped for corresponding with an outer circumferential side of said motor.

5. The ceiling fan as claimed in claim 1, wherein said threaded cylinder is a protruding stud, which is axially provided with an internal threaded hole.

6. The ceiling fan as claimed in claim 1, wherein said at least one fixed seat is optional to be secured at topside or at underside of said motor.

7. The ceiling fan as claimed in claim 1, wherein said extension portion of said blade is arc-shaped for corresponding with an outer circumferential side of said motor, and said pressing plate is also arc-shaped to correspond with said extension portion of said blade.

* * * * *